US005469786A

United States Patent [19]

Harris

[11] Patent Number: 5,469,786

[45] Date of Patent: Nov. 28, 1995

[54] ENCLOSED INK CUP WITH IMPROVED SEAL

[75] Inventor: Kenneth R. Harris, Byfield, Mass.

[73] Assignee: Imtran Industries, Inc., Newburyport, Mass.

[21] Appl. No.: 328,452

[22] Filed: Oct. 25, 1994

[51] Int. Cl.[6] ..... B41F 17/00

[52] U.S. Cl. ..... 101/163; 101/109; 101/170; 101/35

[58] Field of Search ..... 101/163, 169, 101/35, 41, 44, 150, 170

[56] References Cited

U.S. PATENT DOCUMENTS

| | | | |
|---|---|---|---|
| 3,742,902 | 7/1973 | Heston, Jr. | 101/129 |
| 4,557,195 | 12/1985 | Phlipp | 101/163 |
| 4,876,982 | 10/1989 | Claasen | 118/413 |
| 4,905,594 | 3/1990 | Phillip et al. | 101/163 |
| 5,095,817 | 3/1992 | Takamura | 101/163 |
| 5,237,922 | 8/1993 | Ho | 101/163 |
| 5,320,037 | 6/1994 | Harris | 101/163 |
| 5,363,761 | 11/1994 | Galassi | 101/163 |

FOREIGN PATENT DOCUMENTS

| | | | |
|---|---|---|---|
| 2205430 | 6/1981 | Germany | 101/163 |

*Primary Examiner*—Edgar S. Burr
*Assistant Examiner*—Lynn D. Hendrickson
*Attorney, Agent, or Firm*—Fish & Richardson

[57] ABSTRACT

An enclosed ink cup for a pad-type printing machine including a hollow structure defining a reservoir region that is closed around the sides and top, is open only at the bottom, and has a lower edge for sealably contacting an engraved printing plate so as to contain ink within the structure over the plate, and a vacuum port in the structure that communicates with the top of the region for applying a vacuum to the region above the ink to promote sealable contact between the lower edge and the plate.

8 Claims, 2 Drawing Sheets

ENCLOSED INK CUP WITH IMPROVED SEAL

BACKGROUND OF THE INVENTION

The invention relates to enclosed ink cups for pad-type printing machines.

On pad-type printing machines, an image engraved in a metal plate is provided with a thin film of ink by an open air system with a flood bar and a doctor blade or by an enclosed ink cup that is slid over the surface of the plate. The doctor blade or the edge of the cup wipes the engraved surface, leaving the ink at only the engraved image. A silicone pad then transfers the ink image from the plate to the object being printed. A variety of mechanisms have been employed to maintain sealable contact of the doctor blade or ink cup edge on the engraved plate; e.g., springs, magnets, and air cylinders have been used to bias the blade against the plate.

Enclosed ink cups have been proposed in response to environmental and health concerns related to vapors evaporating from exposed ink. For example, Phillip et al. U.S. Pat. No. 4,905,594 describes an enclosed ink cup that has a hollow body that can be bent in the area of its end face and employs a bellows structure to permit relative movement between the area of the end face and the remaining part of the hollow body in order to provide a sealable contact between the ink cup and the printing plate surface on printing plates whose surfaces exhibit deviations from a plane. Phlipp U.S. Pat. No. 4,557,195 describes an enclosed ink cup having a two-piece hollow body. The two parts are movable in relation to each other to ensure exact abutment on the printing plate surface independent of production tolerances. My U.S. Pat. No. 5,320,037, which is hereby incorporated by reference, describes an enclosed ink cup that employs a sheet metal band to make sealable contact with the printing plate.

SUMMARY OF THE INVENTION

The invention features, in general, an enclosed ink cup for a pad-type printing machine. The cup includes a hollow structure that defines a reservoir region that is closed around the sides and top. The structure has a lower edge that sealably contacts an engraved printing plate so as to contain ink within the structure over the plate. The structure also has a vacuum port that communicates with the top of enclosed region. A vacuum source connected to the port creates a negative pressure within the sealed cup creating a tight seal between the cup and the plate applied uniformly around the cup.

In preferred embodiments the vacuum source is adjustable to guarantee that there is sufficient pressure to make a good seal, but not so much pressure as to prevent lateral movement of the cup over the plate, as is necessary during printing. A wide variety of cups can be used, e.g., ceramic edge cups and cups with a sheet metal band.

Other advantages and features of the invention will be apparent from the following description of the preferred embodiment thereof and from the claims.

DESCRIPTION OF THE PREFERRED EMBODIMENTS

Figure 1:
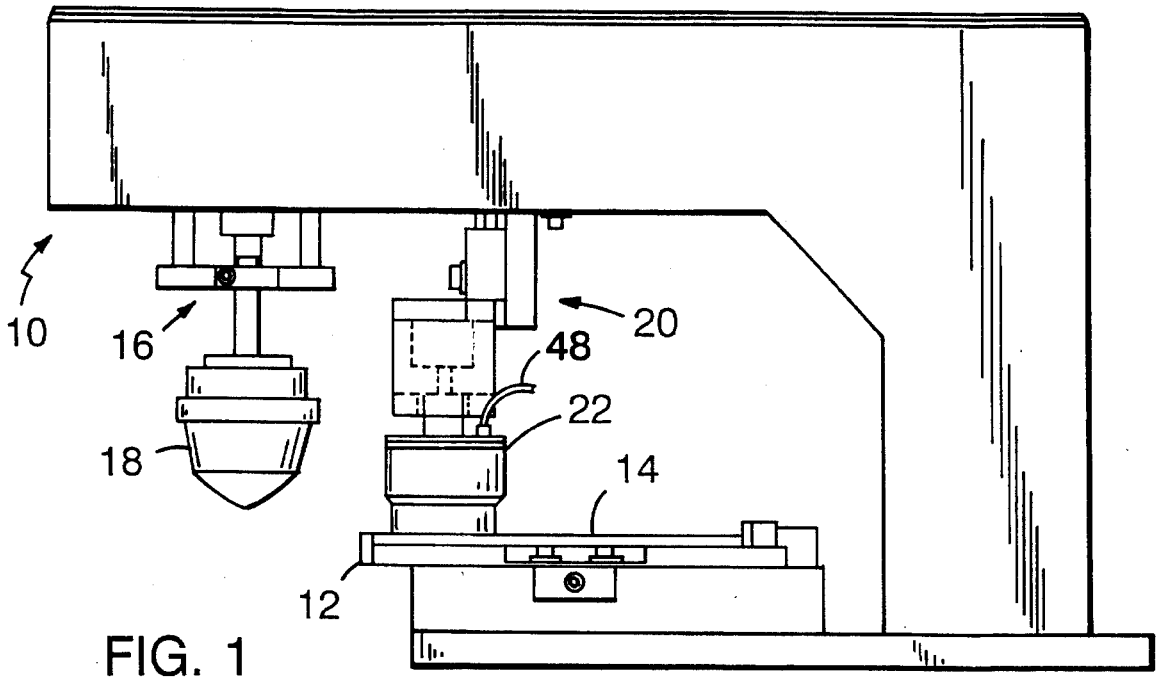
FIG. 1 is an elevation of a pad-type printing machine including an enclosed ink cup according to the invention.

Referring to FIG. 1, there is shown pad-type printing machine 10. It includes printing plate support 12 for supporting engraved printing plate 14 thereon, pad transport mechanism 16 for transporting pad 18, and ink cup transport mechanism 20 for sliding enclosed ink cup 22. Pad transport mechanism 16 moves pad 18 in both vertical and horizontal directions. Transport mechanism 20 moves ink cup 22 only in a horizontal direction, sliding ink cup 22 across the upper surface of printing plate 14.

Figure 2:
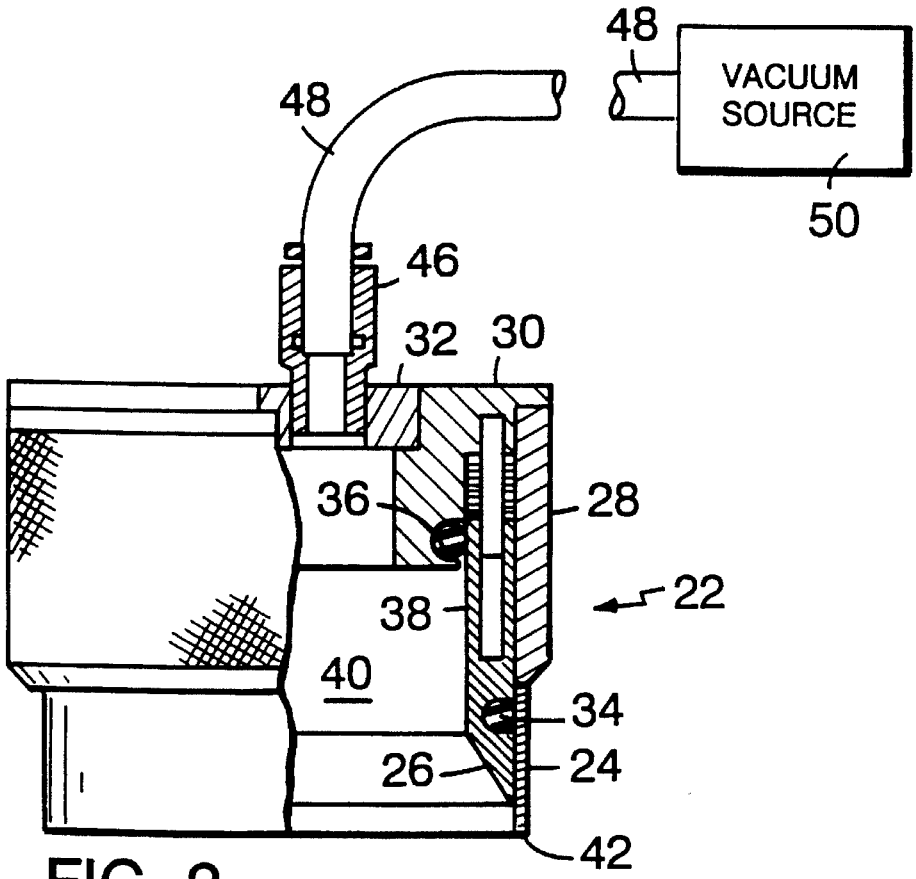
FIG. 2 is an elevation, partially in section, of the enclosed ink cup of the FIG. 1 printing machine.

Referring to FIG. 2, enclosed ink cup 22 includes continuous, sheet metal band 24, hollow support member 26, band adjustment member 28, cap member 30, plug 32, and elastomeric sealing rings 34, 36. Hollow support 26 has continuous cylindrical wall 38 surrounding and defining reservoir region 40 therein. Sheet metal band 24 has lower edge surface 42 for making sealable contact on the upper surface of printing plate 14. Plug 32 has a threaded recess (not shown) for mechanical connection to transport mechanism 20 and vacuum port 46 therethrough connected to hose 48. Hose 48 is connected to a vacuum source 50 (shown diagrammatically in FIG. 2) having adjustable vacuum.

Figure 3:
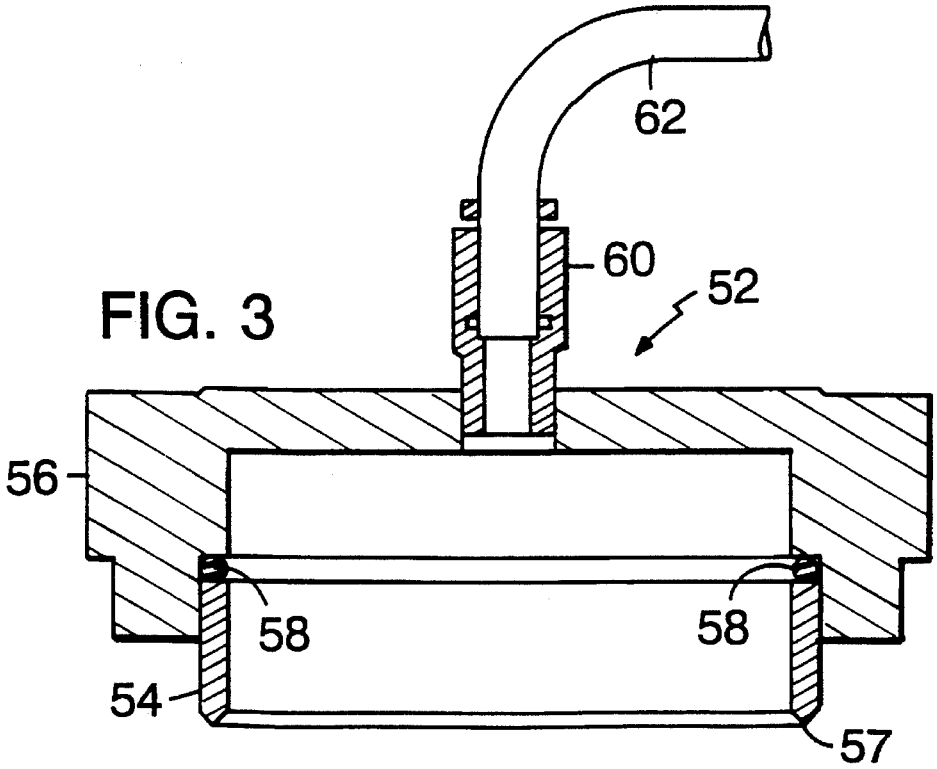
FIG. 3 is a sectional view of an alternative embodiment of an ink cup according to the invention.

Referring to FIG. 3, ink cup 52 includes ceramic ring 54, support 56 thereover, and O-ring seal 58 providing a seal between ring 54 and support 56. Ring 54 has lower edge surface 57 for making sealable contact on the upper surface of the printing plate. Support 56 has vacuum port 60 connected via hose 62 to an adjustable vacuum source (not shown). Ink cup 52 can be used in place of ink cup 22.

In operation, reservoir region 40 is filled with ink, and pad transport mechanism 16 and ink cup transport mechanism 20 move in coordinated fashion to cause ink cup 22 to provide a thin film of ink on the engraved area of plate 14 and to cause pad 18 to pick up the ink image and transfer it to the object being printed.

Figure 4:
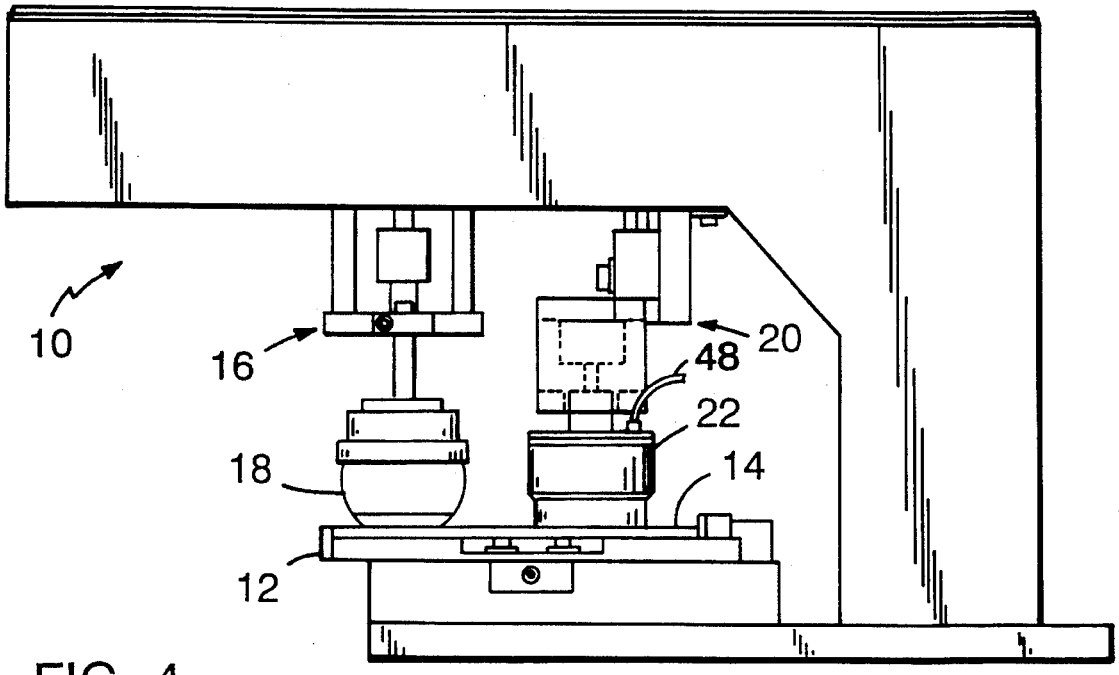
FIG. 4 is an elevation of the FIG. 1 printing machine shown with its ink cup and pad in different positions.

In the position shown in FIG. 1, ink cup 22 is over the engraved area of printing plate 14. Ink cup transport mechanism 20 then slides ink cup 22 to the right to the position shown in FIG. 4. During this sliding operation, lower edge 42 of band 24 wipes the upper surface of printing plate 14, leaving a thin film of ink on the engraved areas only. Simultaneously with the horizontal movement of transport mechanism 20 and ink cup 22, transport mechanism 16 moves pad 18 horizontally to a position over the engraved area and then vertically lowers pad 18 to the position shown in FIG. 4 in order to pick up the ink image.

Transport mechanism 16 then raises pad 18 and moves to the left to the position shown in FIG. 1 and then vertically lowers pad 18 onto the object (not shown) being printed. While transport mechanism 16 is moving to the left, transport mechanism 20 moves ink cup 22 to the left in order to expose the engraved area to ink to provide ink for the next image to be transferred.

Enclosed ink cup 22 prevents ink vapors from escaping to the work place. The application of vacuum to the enclosed ink reservoir region provides a sealing force that is uniformly applied around the circumference of the lower edge. This provides a good seal between the lower edge and plate surface and good wiping of the ink over the image. The vacuum is adjusted to get the desired amount of seal without applying so much force as to prevent lateral movement of the cup across the plate.

OTHER EMBODIMENTS

Other embodiments of the invention are within the scope of the following claims.

What is claimed is:

1. An enclosed ink cup for a pad-type printing machine comprising a hollow structure defining a reservoir region that is closed around the sides and top and is open only at the bottom of said reservoir region, said structure having a lower edge for sealably contacting an engraved printing plate so as to contain ink within said structure over said plate, and a vacuum port in said structure communicating with the top of said region for applying a vacuum to said region above said ink to promote sealable contact between said lower edge and said plate.

2. The cup of claim 1 further comprising a vacuum source connected to said port, said source having adjustable vacuum.

3. The cup of claim 1 wherein said structure includes a hollow support and a sheet metal band that is mounted on said support and provides said lower edge.

4. The cup of claim 1 wherein said structure includes a ceramic ring member that provides said lower edge.

5. A pad-type printing press machine comprising a printing plate support, an engraved printing plate on said support, a pad and transport mechanism for moving said pad from an engraved area of said printing plate to an object being printed, an ink cup on said printing plate, and a transport mechanism for sliding said ink cup on said plate between said engraved area of said plate and another area of said plate, said ink cup comprising a hollow structure defining a reservoir region that is closed around the sides and top and is open only at the bottom of said reservoir region, said structure having a lower edge for sealably contacting said engraved printing plate so as to contain ink within said structure over said plate, and a vacuum port in said structure communicating with the top of said region for applying a vacuum to said region above said ink to promote sealable contact between said lower edge and said plate.

6. The machine of claim 5 further comprising a vacuum source connected to said port, said source having adjustable vacuum.

7. The machine of claim 5 wherein said structure includes a hollow support and a sheet metal band that is mounted on said support and provides said lower edge.

8. The machine of claim 5 wherein said structure includes a ceramic ring member that provides said lower edge.

* * * * *